US005521059A

United States Patent [19]

Ishida et al.

[11] Patent Number: 5,521,059

[45] Date of Patent: May 28, 1996

[54] RIBONUCLEIC ACID (RNA) AS AN ANTIFOGGANT AND PRINT STABILIZER FOR PHOTOTHERMOGRAPHIC ELEMENTS

[75] Inventors: Takuzo Ishida, Woodbury; Frank J. Manganiello, St. Paul; Kumars Sakizadeh, Woodbury, all of Minn.

[73] Assignee: Minnesota Mining and Manufacturing Company, St. Paul, Minn.

[21] Appl. No.: 428,383

[22] Filed: Apr. 25, 1995

[51] Int. Cl.[6] ..... G03C 1/498

[52] U.S. Cl. ..... 430/617; 430/607; 430/619

[58] Field of Search ..... 430/617, 619, 430/607

[56] References Cited

U.S. PATENT DOCUMENTS 4,892,809 1/1990 Momoki ..... 430/550

5,071,740 12/1991 Okauchi et al. ..... 430/617

OTHER PUBLICATIONS

H. Hermel and A. Huttner, "*Partially Decomposed DNA as Antifoggant and Sensitizer in the Chemical Ripening Process*", *Journal of Imaging Science and Technology*, vol. 36, No. 3, May/Jun. 1992.

*Primary Examiner*—Thorl Chea

*Attorney, Agent, or Firm*—Gary L. Griswold; Walter N. Kirn; Gregory A. Evearitt

[57] ABSTRACT

Ribonucleic acid (RNA) compounds have been found to function as antifoggants and post-processing print stabilizers in photothermographic elements.

11 Claims, No Drawings

RIBONUCLEIC ACID (RNA) AS AN ANTIFOGGANT AND PRINT STABILIZER FOR PHOTOTHERMOGRAPHIC ELEMENTS

BACKGROUND OF THE INVENTION

1. Field of Invention

This invention relates to novel, heat-developable photothermographic elements and in particular, it relates to ribonucleic acids (RNA) as antifoggants and post-processing print stabilizers for photothermographic elements.

2. Background of the Art

Silver halide-containing, photothermographic imaging materials (i.e., heat-developable photographic elements) processed with heat, and without liquid development, have been known in the art for many years. These elements are also known as "dry silver" compositions or emulsions and generally comprise a support having coated thereon: (a) a photosensitive compound that generates silver atoms when irradiated; (b) a non-photosensitive, reducible silver source; (c) a reducing agent (i.e., a developer) for silver ion, for example the silver ion in the non-photosensitive, reducible silver source; and (d) a binder.

The photosensitive compound is generally photographic silver halide which must be in catalytic proximity to the non-photosensitive, reducible silver source. Catalytic proximity requires an intimate physical association of these two materials so that when silver atoms (also known as silver specks, clusters, or nuclei) are generated by irradiation or light exposure of the photographic silver halide, those nuclei are able to catalyze the reduction of the reducible silver source. It has long been understood that silver atoms (Ag°) are a catalyst for the reduction of silver ions, and that the photosensitive silver halide can be placed into catalytic proximity with the non-photosensitive, reducible silver source in a number of different fashions. The silver halide may be made "in situ," for example by adding a halogen-containing source to the reducible silver source to achieve partial metathesis (see, for example, U.S. Pat. No. 3,457,075); or by coprecipitation of silver halide and the reducible silver source (see, for example, U.S. Pat. No. 3,839,049). The silver halide may also be made "ex situ" and added to the organic silver salt. The addition of silver halide grains to photothermographic elements is described in *Research Disclosure,* June 1978, Item No. 17029. It is also reported in the art that when silver halide is made ex situ, one has the possibility of controlling the composition and size of the grains much more precisely, so that one can impart more specific properties to the photothermographic element and can do so much more consistently than with the in situ technique.

The non-photosensitive, reducible silver source is a compound that contains silver ions. Typically, the preferred non-photosensitive reducible silver source is a silver salt of a long chain aliphatic carboxylic acid having from 10 to 30 carbon atoms. The silver salt of behenic acid or mixtures of acids of similar molecular weight are generally used. Salts of other organic acids or other organic compounds, such as silver imidazolates, have been proposed. U.S. Pat. No. 4,260,677 discloses the use of complexes of inorganic or organic silver salts as non-photosensitive, reducible silver sources.

In both photographic and photothermographic emulsions, exposure of the photographic silver halide to light produces small clusters of silver atoms (Ag°). The imagewise distribution of these clusters is known in the art as a latent image.

This latent image is generally not visible by ordinary means. Thus, the photosensitive emulsion must be further processed to produce a visible image. This is accomplished by the reduction of silver ions which are in catalytic proximity to silver halide grains bearing the clusters of silver atoms, (i.e., the latent image). This produces a black and white image. In photographic elements, the silver halide is reduced to form the black-and-white image. In photothermographic elements, the light-insensitive silver source is reduced to form the visible black-and-white image while much of the silver halide remains as silver halide and is not reduced.

In photothermographic elements the reducing agent for the organic silver salt, often referred to as a "developer," may be any compound, preferably any organic compound, that can reduce silver ion to metallic silver. At elevated temperatures, in the presence of the latent image, the non-photosensitive reducible silver source (e.g., silver behenate) is reduced by the reducing agent for silver ion. This produces a negative black-and-white image of elemental silver.

While conventional photographic developers such as methyl gallate, hydroquinone, substituted-hydroquinones, catechol, pyrogallol, ascorbic acid, and ascorbic acid derivatives are useful, they tend to result in very reactive photothermographic formulations and fog during preparation and coating of photothermographic elements. As a result, hindered phenol developers (i.e., reducing agents) have traditionally been preferred.

As the visible image in black-and-white photothermographic elements is usually produced entirely by elemental silver (Ag°), one cannot readily decrease the amount of silver in the emulsion without reducing the maximum image density. However, reduction of the amount of silver is often desirable to reduce the cost of raw materials used in the emulsion and/or to enhance performance. For example, toning agents may be incorporated to improve the color of the silver image of the photothermographic elements as described in U.S. Pat. Nos. 3,846,136; 3,994,732; and 4,021,249.

Another method of increasing the maximum image density in photographic and photothermographic emulsions without increasing the amount of silver in the emulsion layer is by incorporating dye-forming or dye-releasing compounds in the emulsion. Upon imaging, the dye-forming or dye-releasing compound is oxidized, and a dye and a reduced silver image are simultaneously formed in the exposed region. In this way, a dye-enhanced black-and-white silver image can be produced. Dye enhanced black-and-white silver image forming compounds and processes are described in U.S. Pat. No. 5,185,231.

The imaging arts have long recognized that the field of photothermography is clearly distinct from that of photography. Photothermographic elements differ significantly from conventional silver halide photographic elements which require wet-processing.

In photothermographic imaging elements, a visible image is created by heat as a result of the reaction of a developer incorporated within the element. Heat is essential for development and temperatures of over 100° C. are routinely required. In contrast, conventional wet-processed photographic imaging elements require processing in aqueous processing baths to provide a visible image (e.g., developing and fixing baths) and development is usually performed at a more moderate temperature (e.g., 30°–50° C.).

In photothermographic elements only a small amount of silver halide is used to capture light and a different form of silver (e.g., silver behenate) is used to generate the image with heat. Thus, the silver halide serves as a catalyst for the development of the non-photosensitive, reducible silver source. In contrast, conventional wet-processed black-and-white photographic elements use only one form of silver (e.g., silver halide) which, upon development, is itself converted to the silver image. Additionally, photothermographic elements require an amount of silver halide per unit area that is as little as one-hundredth of that used in conventional wet-processed silver halide.

Photothermographic systems employ a light-insensitive silver salt, such as silver behenate, which participates with the developer in developing the latent image. In contrast, photographic systems do not employ a light-insensitive silver salt directly in the image-forming process. As a result, the image in photothermographic elements is produced primarily by reduction of the light-insensitive silver source (silver behenate) while the image in photographic black-and-white elements is produced primarily by the silver halide.

In photothermographic elements, all of the "chemistry" of the system is incorporated within the element itself. For example, photothermographic elements incorporate a developer (i.e., a reducing agent for the non-photosensitive reducible source of silver) within the element while conventional photographic elements do not. The incorporation of the developer into photothermographic elements can lead to increased formation of "fog" upon coating of photothermographic emulsions. Even in so-called instant photography, the developer chemistry is physically separated from the silver halide until development is desired. Much effort has gone into the preparation and manufacture of photothermographic elements to minimize formation of fog upon coating, storage, and post-processing aging.

Similarly, in photothermographic elements, the unexposed silver halide inherently remains after development and the element must be stabilized against further development. In contrast, the silver halide is removed from photographic elements after development to prevent further imaging (i.e., the fixing step).

In photothermographic elements the binder is capable of wide variation and a number of binders are useful in preparing these elements. In contrast, photographic elements are limited almost exclusively to hydrophilic colloidal binders such as gelatin.

Because photothermographic elements require thermal processing, they pose different considerations and present distinctly different problems in manufacture and use. In addition, the effects of additives (e.g., stabilizers, antifoggants, speed enhancers, sensitizers, supersensitizers, etc.) which are intended to have a direct effect upon the imaging process can vary depending upon whether they have been incorporated in a photothermographic element or incorporated in a photographic element.

Because of these and other differences, additives which have one effect in conventional silver halide photography may behave quite differently in photothermographic elements where the underlying chemistry is so much more complex. For example, it is not uncommon for an antifoggant for a silver halide systems to produce various types of fog when incorporated into photothermographic elements.

Distinctions between photothermographic and photographic elements are described in *Imaging Processes and Materials* (*Neblette's Eighth Edition*); J. Sturge et al. Ed; Van Nostrand Reinhold: New York, 1989; Chapter 9 and in *Unconventional Imaging Processes;* E. Brinckman et al, Ed; The Focal Press: London and New York: 1978; pp. 74–75.

Various techniques are typically employed to try and gain higher sensitivity in a photothermographic element. In efforts to make more sensitive photothermographic elements, one of the most difficult parameters to maintain at a very low level is the various types of fog or Dmin. Fog is spurious image density which appears in non-imaged areas of the element after development and is often reported in sensitometric results as Dmin. Photothermographic emulsions, in a manner similar to photographic emulsions and other light-sensitive systems, tend to suffer from fog.

Traditionally, photothermographic elements have suffered from fog upon coating. The fog level of freshly prepared photothermographic elements will be referred to herein as initial fog or initial Dmin.

In addition, the fog level of photothermographic elements often rises as the element is stored, or "ages." This type of fog will be referred to herein as shelf-aging fog. Adding to the difficulty of fog control on shelf-aging is the fact that the developer is incorporated in the photothermographic element. This is not the case in most silver halide photographic systems. A great amount of work has been done to improve the shelf-life characteristics of photothermographic elements.

A third type of fog in photothermographic systems results from the instability of the image and/or background after processing. The photoactive silver halide still present in the developed image may continue to catalyze formation of metallic silver during room light handling or post-processing exposure such as in graphic arts contact frames. This is known as "post-processing fog" or "silver printout." Without having acceptable resistance to fog, a commercially useful element is difficult to prepare. Thus, there exists a need for "print stabilizers" to stabilize the unreacted silver halide. Various techniques have been employed to improve sensitivity and maintain resistance to fog.

In color photothermographic elements, often unreacted dye forming or dye releasing compounds may slowly oxidize and form areas of color in the unexposed areas. In these elements, stabilizers are often added to reduce "leuco dye backgrounding."

The addition of separate post-processing image stabilizers or stabilizer precursors provides the desired post-processing stability. Most often these are sulfur-containing compounds such as mercaptans, thiones, and thioethers as described in *Research Disclosure,* June 1978, item 17029. U.S. Pat. No. 4,245,033 describes sulfur compounds of the mercapto-type that are development restrainers of a photothermographic system. See also U.S. Pat. Nos. 4,837,141 and 4,451,561. Mesoionic 1,2,4-triazolium-3-thiolates as fixing agents and silver halide stabilizers are described in U.S. Pat. No. 4,378,424. Substituted 5-mercapto-1,2,4-triazoles, such as 3-amino- 5-benzothio-1,2,4-triazole, used as post-processing stabilizers are described in U.S. Pat. Nos. 4,128,557; 4,137,079; 4,138,265; and *Research Disclosure* 16977 and 16979.

Some of the problems with these stabilizers include thermal fogging during processing or losses in photographic sensitivity, maximum density, or contrast at effective stabilizer concentrations.

Stabilizer precursors have blocking or modifying groups that are cleaved during processing with heat, light, and/or alkali. This provides an active stabilizer that can combine with the photoactive silver halide in the unexposed areas of the photographic element to form a light- and heat-stable complex. For example, in the presence of a stabilizer precursor in which the blocking group on a sulfur atom is cleaved upon processing, the resulting silver mercaptide will be more stable than silver halide to light, and heat.

Blocking groups that are thermally-sensitive have also been used. These blocking groups are removed by heating the imaging element during processing. For example, U.S. Pat. No. 5,158,866 describes the use of omega-substituted 2-propionamidoacetal or 3-propionamidopropionyl stabilizer precursors as post-processing stabilizers in photothermographic elements. U.S. Pat. No. 5,175,081 describes the use of certain azlactones as stabilizers. U.S. Pat. No. 5,298,390 describes the use of certain alkyl sulfones as blocked compounds capable of releasing stabilizers with heat. U.S. Pat. No. 5,300,420 describes the use of certain nitriles as blocked compounds capable of releasing stabilizers with heat.

Various disadvantages attend these different blocking techniques. Highly basic solutions that are necessary to cause unblocking of the alkali-sensitive blocked derivatives are corrosive and irritating to the skin. With photographic stabilizers that are blocked with a heat-removable group, it is often found that the liberated reagent or by-product can react with other components of the photothermographic element and cause adverse effects. Also, premature release of the stabilizing moiety within the desired time during processing may occur, resulting in fogging of the emulsion or loss of sensitivity.

It is known that, DNA, RNA, and their decomposition products are photographic restrainers which differ from one another in efficiency. As described by Steigmann (*Sci. Indust. Photogr.* 1964, 35, 145) and Ammann-Brass (*J. Photogr. Sci.* 1972, 20, 37) the physical and chemical ripening of silver halide is more strongly inhibited by partially decomposed DNA than by the undestroyed double-strand DNA or the mononucleotides and mononucleosides. Also the products of full decomposition of the DNA have a slow restraining action smaller than that of the intact DNA. Likewise, the oligonucleotides have little or even no effect on ripening. It is also known (G. B. Tagliafico, *J. Photogr. Sci.* 1969, 17, 17 that when DNA is completely decomposed into oligonucleotides, has no restraining effect on the chemical ripening of an ammoniacal silver bromide emulsion either. These experiments indicate that evidently the optimum restraining of DNA can be obtained with its partially decomposed molecules. A recent study (H. Hermel and A. Huttner *J. Imag. Sci. Tec.* 1992, 36 (3),287) shows that partially decomposed DNA acts as antifoggant and sensitizer in the chemical ripening process. Similar results have been observed when partially decomposed DNA prepared by ultrasonic treatment was added to an X-ray emulsion, a negative emulsion, a direct positive emulsion, and a reprolith emulsion during the chemical ripening process.

There is a continued need for improved stabilizer compounds that inhibit all types of fog and do not have any detrimental effects on the photothermographic element.

SUMMARY OF THE INVENTION

The present invention provides heat-developable, photothermographic elements which are capable of providing high photospeed; stable, high density images of high resolution and good sharpness; and good shelf stability.

The present invention provides photothermographic elements coated on a support wherein the photothermographic element comprises:

(a) a photosensitive silver halide;

(b) a non-photosensitive, reducible source of silver;

(c) a reducing agent for the non-photosensitive, reducible source of silver;

(d) a binder; and (e) RNA.

When the photothermographic element used in this invention is heat developed, preferably at a temperature of from about 80° C. to about 250° C. (176° F. to 482° F.) for a duration of from about 1 second to about 2 minutes, in a substantially water-free condition after, or simultaneously with, imagewise exposure, a black-and-white silver image is obtained.

The reducing agent for the non-photosensitive silver source may be any conventional photographic developer such as methyl gallate, hydroquinone, substituted-hydroquinones, catechol, pyrogallol, ascorbic acid, and ascorbic acid derivatives. However, it is preferred that the reducing agent be a hindered phenol developer. Further, the reducing agent may optionally comprise a compound capable of being oxidized to form or release a dye. Preferably the dye-forming compound is a leuco dye.

According to the present invention, one or more RNA compounds is added either to the emulsion layer(s) or to a layer or layers adjacent to the emulsion layer(s). Layers that are adjacent to the emulsion layer(s) may be, for example, protective topcoat layers, primer layers, interlayers, opacifying layers, antihalation layers, barrier layers, auxiliary layers, etc. It is preferred that the RNA compound be present in the photothermographic emulsion layer or topcoat layer.

The present invention also provides a process for the formation of a visible image by first exposing to electromagnetic radiation and thereafter heating the inventive photothermographic element described earlier herein.

The present invention also provides a process comprising the steps of:

(a) exposing the inventive photothermographic element described earlier herein to electromagnetic radiation, to which the silver halide grains of the element are sensitive, to generate a latent image;

(b) heating the exposed element to develop the latent image into a visible image;

(c) positioning the element with a visible image thereon between a source of ultraviolet or short wavelength visible radiation energy and an ultraviolet or short wavelength radiation photosensitive imageable medium; and (d) thereafter exposing the imageable medium to ultraviolet or short wavelength visible radiation through the visible image on the element, thereby absorbing ultraviolet or short wavelength visible radiation in the areas of the element where there is a visible image and transmitting ultraviolet or short wavelength visible radiation through areas of the element where there is no visible image.

The photothermographic element may be exposed in step (a) with visible, infrared, or laser radiation.

The photothermographic elements of this invention may be used to prepare black-and-white, monochrome, or full color images. The photothermographic element of this invention can be used, for example, in conventional black-and-white or color photothermography, in electronically generated black-and-white or color hardcopy recording, in the graphic arts area (e.g., phototypesetting), in digital proofing, and in digital radiographic imaging. The element of this invention provides high photospeeds, provides strongly absorbing black-and-white or color images, and provides a dry and rapid process.

Heating in a substantially water-free condition as used herein, means heating at a temperature of 80° to 250° C. The term "substantially water-free condition" means that the reaction system is approximately in equilibrium with water in the air, and water for inducing or promoting the reaction is not particularly or positively supplied from the exterior to the element. Such a condition is described in T. H. James, *The Theory of the Photographic Process,* Fourth Edition, Macmillan 1977, page 374.

As used herein:

"photothermographic element" means a construction comprising at least one photothermographic emulsion layer and any supports, topcoat layers, image receiving layers, blocking layers, antihalation layers, subbing or priming layers, etc;

"emulsion layer" means a layer of a photothermographic element that contains the non-photosensitive, reducible silver source and the photosensitive silver halide;

"ultraviolet region of the spectrum" means that region of the spectrum less than or equal to about 400 nm, preferably from about 100 nm to about 400 nm. More preferably, the ultraviolet region of the spectrum is the region between about 190 nm and about 400 nm;

"short wavelength visible region of the spectrum" means that region of the spectrum from about 400 nm to about 450 nm;

"infrared region of the spectrum" means from about 750 nm to about 1400 nm; "visible region of the spectrum" means from about 400 nm to about 750 nm; and "red region of the spectrum" means from about 640 nm to about 750 nm. Preferably the red region of the spectrum is from about 650 nm to about 700 nm.

Other aspects, advantages, and benefits of the present invention are apparent from the detailed description, examples, and claims.

DETAILED DESCRIPTION OF THE INVENTION

Incorporation of RNA in a photothermographic element appears novel. We have found that addition of RNA, preferably Calf Liver RNA to the silver emulsion layer or topcoat layer of a photothermographic element reduces shelf-age fog and improves post-processing stability of photothermographic elements, preferably black-and-white photothermographic elements.

In contrast, when DNA was added during the preparation of the homogenate (in a manner analogous to that used in wet silver halide), a completely fogged photothermographic element was obtained on coating.

The RNA used in the present invention typically comprises from about 0.1 wt % to 50 wt % of the dried layer of the photothermographic element in which they are placed. They may be incorporated directly into the silver-containing layer, into an adjacent layer, or an image-receiving layer. The RNA used in the present invention is especially useful in photothermographic elements and constructions for preparation of black-and-white, monochrome, and full color images.

The amounts of the above-described RNA stabilizer compounds that are added to the photothermographic element of the present invention may be varied depending upon the particular compound used, upon the type of emulsion layer (e.g., black-and-white vs. color), and whether the stabilizer is located in the emulsion layer, topcoat layer, or image receiving layer.

Photothermographic elements of the invention may contain other post-processing stabilizers or stabilizer precursors in combination with the compounds of the invention, as well as other additives in combination with the compounds of the invention such as shelf-life stabilizers, toners, development accelerators, and other image-modifying agents.

The Photosensitive Silver Halide

As noted above, the present invention includes a photosensitive silver halide. The photosensitive silver halide can be any photosensitive silver halide, such as silver bromide, silver iodide, silver chloride, silver bromoiodide, silver chlorobromoiodide, silver chlorobromide, etc. The photosensitive silver halide can be added to the emulsion layer in any fashion so long as it is placed in catalytic proximity to the organic silver compound which serves as a source of reducible silver.

The silver halide may be in any form which is photosensitive including, but not limited to cubic, octahedral, rhombic dodecahedral, orthorhombic, tetrahedral, other polyhedral habits, etc., and may have epitaxial growth of crystals thereon.

The silver halide grains may have a uniform ratio of halide throughout; they may have a graded halide content, with a continuously varying ratio of, for example, silver bromide and silver iodide; or they may be of the core-shell-type, having a discrete core of one halide ratio, and a discrete shell of another halide ratio. Core-shell silver halide grains useful in photothermographic elements and methods of preparing these materials are described in U.S. Pat. No. 5,382,504. A core-shell silver halide grain having an iridium doped core is particularly preferred. Iridium doped core-shell grains of this type are described in U.S. patent application Ser. No. 08/239,984 (filed May 9, 1994).

The silver halide may be prepared ex situ, (i.e., be pre-formed) and mixed with the organic silver salt in a binder prior to use to prepare a coating solution. The silver halide may be pre-formed by any means, e.g., in accordance with U.S. Pat. No. 3,839,049. For example, it is effective to blend the silver halide and organic silver salt using a homogenizer for a long period of time. Materials of this type are often referred to as "pre-formed emulsions." Methods of preparing these silver halide and organic silver salts and manners of blending them are described in *Research Disclosure,* June 1978, item 17029; U.S. Pat. Nos. 3,700,458 and 4,076,539; and Japanese Patent Application Nos. 13224/74, 42529/76, and 17216/75.

It is desirable in the practice of this invention to use pre-formed silver halide grains of less than 0.10 μm in an infrared sensitized, photothermographic element. It is also preferred to use iridium doped silver halide grains and iridium doped core-shell silver halide grains as disclosed in U.S. patent application Ser. Nos. 08/072,153, and 08/239,984 described above.

Pre-formed silver halide emulsions when used in the element of this invention can be unwashed or washed to remove soluble salts. In the latter case, the soluble salts can be removed by chill-setting and leaching or the emulsion can be coagulation washed, e.g., by the procedures described in U.S. Pat. Nos. 2,618,556; 2,614,928; 2,565,418; 3,241,969; and 2,489,341.

It is also effective to use an m situ process, i.e., a process in which a halogen-containing compound is added to an organic silver salt to partially convert the silver of the organic silver salt to silver halide.

The light sensitive silver halide used in the present invention can be employed in a range of about 0.005 mole to about 0.5 mole; preferably, from about 0.01 mole to about 0.15 mole per mole; and more preferably, from 0.03 mole to 0.12 mole per mole of non-photosensitive reducible silver salt.

Sensitizers

The silver halide used in the present invention may be chemically and spectrally sensitized in a manner similar to that used to sensitize conventional wet-processed silver halide photographic materials or state-of-the-art heat-developable photothermographic elements.

For example, it may be chemically sensitized with a chemical sensitizing agent, such as a compound containing sulfur, selenium, tellurium, etc., or a compound containing gold, platinum, palladium, ruthenium, rhodium, iridium, etc., a reducing agent such as a tin halide, etc., or a combination thereof. The details of these procedures are described in T. H. James, *The Theory of the Photographic Process,* Fourth Edition, Chapter 5, pp. 149 to 169. Suitable chemical sensitization procedures are also desclosed in Shepard, U.S. Pat. No. 1,623,499; Waller, U.S. Pat. No. 2,399,083; McVeigh, U.S. Pat. No. 3,297,447; and Dunn, U.S. Pat. No. 3,297,446.

Addition of sensitizing dyes to the photosensitive silver halides serves to provide them with high sensitivity to visible and infrared light by spectral sensitization. Thus, the photosensitive silver halides may be spectrally sensitized with various known dyes that spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. Of these dyes, cyanine dyes, merocyanine dyes, and complex merocyanine dyes are particularly useful. Suitable sensitizing dyes are described, for example, in U.S. Pat. Nos. 3,719,495 and 5,393,654.

An appropriate amount of sensitizing dye added is generally about $10^{-10}$ to $10^{-1}$ mole; and preferably, about $10^{-8}$ to $10^{-3}$ moles per mole of silver halide.

Supersensitizers

To get the speed of the photothermographic elements up to maximum levels and further enhance sensitivity, it is often desirable to use supersensitizers. Any supersensitizer can be used which increases the sensitivity. For example, preferred infrared supersensitizers are described in U.S. patent application Ser. No. 07/846,919 and include heteroaromatic mercapto compounds or heteroaromatic disulfide compounds of the formula:

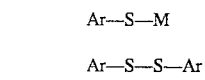

Ar—S—M

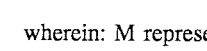

Ar—S—S—Ar wherein: M represents a hydrogen atom or an alkali metal atom.

In the above noted supersensitizers, Ar represents a heteroaromatic ring or fused heteroaromatic ring containing one or more of nitrogen, sulfur, oxygen, selenium or tellurium atoms. Preferably, the heteroaromatic ring is benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline or quinazolinone. However, other heteroaromatic rings are envisioned under the breadth of this invention.

The heteroaromatic ring may also carry substituents with examples of preferred substituents being selected from the group consisting of halogen (e.g., Br and Cl), hydroxy, amino, carboxy, alkyl (e.g., of 1 or more carbon atoms, preferably 1 to 4 carbon atoms) and alkoxy (e.g., of 1 or more carbon atoms, preferably of 1 to 4 carbon atoms.

Preferred supersensitizers are 2-mercaptobenzimidazole, 2-mercapto- 5-methylbenzimidazole, 2-mercaptobenzothiazole, and 2-mercaptobenzoxazole.

The supersensitizers are used in general amount of at least 0.001 moles of sensitizer per mole of silver in the emulsion layer. Usually the range is between 0.001 and 1.0 moles of the compound per mole of silver and preferably between 0.01 and 0.3 moles of compound per mole of silver.

The Non-Photosensitive Reducible Silver Source

The present invention includes a non-photosensitive reducible silver source. The non-photosensitive reducible silver source that can be used in the present invention can be any compound that contains a source of reducible silver ions. Preferably, it is a silver salt which is comparatively stable to light and forms a silver image when heated to 80° C. or higher in the presence of an exposed photocatalyst (such as silver halide) and a reducing agent.

Silver salts of organic acids, particularly silver salts of long chain fatty carboxylic acids, are preferred. The chains typically contain 10 to 30, preferably 15 to 28, carbon atoms. Suitable organic silver salts include silver salts of organic compounds having a carboxyl group. Examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate, silver camphorate, and mixtures thereof, etc. Silver salts that can be substituted with a halogen atom or a hydroxyl group also can be effectively used. Preferred examples of the silver salts of aromatic carboxylic acid and other carboxyl group-containing compounds include: silver benzoate, a silver-substituted benzoate, such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc.; silver gallate; silver tannate; silver phthalate; silver terephthalate; silver salicylate; silver phenylacetate; silver pyromellilate; a silver salt of 3-carboxymethyl-4-methyl- 4-thiazoline-2-thione or the like as described in U.S. Pat. No. 3,785,830; and a silver salt of an aliphatic carboxylic acid containing a thioether group as described in U.S. Pat. No. 3,330,663.

Silver salts of compounds containing mercapto or thione groups and derivatives thereof can also be used. Preferred examples of these compounds include: a silver salt of 3-mercapto-4-phenyl- 1,2,4-triazole; a silver salt of 2-mercaptobenzimidazole; a silver salt of 2-mercapto- 5-aminothiadiazole; a silver salt of 2-(2-ethylglycolamido)benzothiazole; a silver salt of thioglycolic acid, such as a silver salt of a S-alkylthioglycolic acid (wherein the alkyl group has from 12 to 22 carbon atoms); a silver salt of a dithiocarboxylic acid such as a silver salt of dithioacetic acid; a silver salt of thioamide; a silver salt of 5-carboxylic-1-methyl- 2-phenyl-4-thiopyridine; a silver salt of mercaptotriazine; a silver salt of 2-mercaptobenzoxazole; a silver salt as described in U.S. Pat. No. 4,123,274, for example, a silver salt of a 1,2,4-mercaptothiazole derivative, such as a silver salt of 3-amino-5-benzylthio-1,2,4-thiazole; and a silver salt of a thione compound, such as a silver salt of 3-(2-carboxyethyl)-4-methyl- 4-thiazoline-2-thione as disclosed in U.S. Pat. No. 3,201,678.

Furthermore, a silver salt of a compound containing an imino group can be used. Preferred examples of these compounds include: silver salts of benzotriazole and substituted derivatives thereof, for example, silver methylbenzotriazole and silver 5-chlorobenzotriazole, etc.; silver salts of 1,2,4-triazoles or 1-H-tetrazoles as described in U.S. Pat. No. 4,220,709; and silver salts of imidazoles and imidazole derivatives.

Silver salts of acetylenes can also be used. Silver acetylides are described in U.S. Pat. Nos. 4,761,361 and 4,775,613.

It is also found convenient to use silver half soaps. A preferred example of a silver half soap is an equimolar blend of silver behenate and behenic acid, which analyzes for about 14.5% silver and which is prepared by precipitation from an aqueous solution of the sodium salt of commercial behenic acid.

Transparent sheet elements made on transparent film backing require a transparent coating. For this purpose a silver behenate full soap, containing not more than about 15% of free behenic acid and analyzing about 22% silver, can be used.

The method used for making silver soap emulsions is well known in the art and is disclosed in *Research Disclosure,* April 1983, item 22812, *Research Disclosure,* October 1983, item 23419, and U.S. Pat. No. 3,985,565.

The silver halide and the non-photosensitive reducible silver source that form a starting point of development should be in catalytic proximity, i.e., reactive association. "Catalytic proximity" or "reactive association" means that they should be in the same layer, in adjacent layers, or in layers separated from each other by an intermediate layer having a thickness of less than 1 micrometer (1 μm). It is preferred that the silver halide and the non-photosensitive reducible silver source be present the same layer.

Photothermographic emulsions containing pre-formed silver halide in accordance with this invention can be sensitized with chemical sensitizers, or with spectral sensitizers as described above.

The source of reducible silver generally constitutes about 5 to about 70% by weight of the emulsion layer. It is preferably present at a level of about 10 to about 50% by weight of the emulsion layer.

The Reducing Agent for the Non-Photosensitive Reducible Silver Source

When used in black-and-white photothermographic elements, the reducing agent for the organic silver salt may be any compound, preferably organic compound, that can reduce silver ion to metallic silver. Conventional photographic developers such as phenidone, hydroquinones, and catechol are useful, but hindered bisphenol reducing agents are preferred.

A wide range of reducing agents has been disclosed in dry silver systems including amidoximes, such as phenylamidoxime, 2-thienylamidoxime and p-phenoxy-phenylamidoxime; azines, such as 4-hydroxy-3,5-dimethoxybenzaldehydeazine; a combination of aliphatic carboxylic acid aryl hydrazides and ascorbic acid, such as 2,2'-bis(hydroxymethyl)propionyl-β-phenylhydrazide in combination with ascorbic acid; a combination of polyhydroxybenzene and hydroxylamine; a reductone and/or a hydrazine, such as a combination of hydroquinone and bis(ethoxyethyl)hydroxylamine, piperidinohexose reductone, or formyl-4-methylphenylhydrazine; hydroxamic acids, such as phenylhydroxamic acid, p-hydroxyphenylhydroxamic acid, and o-alaninehydroxamic acid; a combination of azines and sulfonamidophenols, such as phenothiazine with p-benzenesulfonamidophenol or 2,6-dichloro-4-benzenesulfonamidophenol; α-cyanophenylacetic acid derivatives, such as ethyl α-cyano-2-methylphenylacetate, ethyl α-cyano-phenylacetate; a combination of bis-o-naphthol and a 1,3-dihydroxybenzene derivative, such as 2,4-dihydroxybenzophenone or 2,4-dihydroxyacetophenone; 5-pyrazolones such as 3-methyl-1-phenyl-5-pyrazolone; reductones, such as dimethylaminohexose reductone, anhydrodihydroaminohexose reductone, and anhydrodihydropiperidone-hexose reductone; sulfonamidophemol reducing agents, such as 2,6-dichloro-4-benzenesulfonamidophenol and p-benzenesulfonamidophenol; indane-1,3-diones, such as 2-phenylindane-1,3-dione; chromans, such as 2,2-dimethyl-7-t-butyl-6-hydroxychroman; 1,4-dihydropyridines, such as 2,6-dimethoxy-3,5-dicarbethoxy-1,4-dihydropyridine; ascorbic acid derivatives, such as 1-ascorbylpalmitate, ascorbylstearate; unsaturated aldehydes and ketones; certain 1,3-indanediones, and 3-pyrazolidones (phenidones).

Hindered bisphenol developers are compounds that contain only one hydroxy group on a given phenyl ring and have at least one additional substituent located ortho to the hydroxy group. They differ from traditional photographic developers which contain two hydroxy groups on the same phenyl ring (such as is found in hydroquinones). Hindered phenol developers may contain more than one hydroxy group as long as they are located on different phenyl rings. Hindered phenol developers include, for example, binaphthols (i.e., dihydroxybinaphthyls), biphenols (i.e., dihydroxybiphenyls), bis(hydroxynaphthyl)methanes, bis(hydroxyphenyl)methanes, hindered phenols, and naphthols.

Non-limiting representative bis-o-naphthols, such as by 2,2'-dihydroxyl-1-binaphthyl, 6,6'-dibromo-2,2'-dihydroxy-1,1'-binaphthyl, and bis(2-hydroxy-1-naphthyl)methane. For additional compounds see U.S. Pat. No. 5,262,295 at column 6, lines 12–13, incorporated herein by reference.

Non-limiting representative biphenols include 2,2'-dihydroxy-3,3'-di-t-butyl-5,5-dimethylbiphenyl; 2,2'-dihydroxy-3,3',5,5'-tetra-t-butylbiphenyl; 2,2'-dihydroxy-3,3'-di-t-butyl-5,5'-dichlorobiphenyl; 2-(2-hydroxy-3-t-butyl-5-methylphenyl)-4-methyl-6-n-hexylphenol; 4,4'-dihydroxy-3,3',5,5'-tetra-t-butylbiphenyl; and 4,4'-dihydroxy-3,3',5,5'-tetramethylbiphenyl. For additional compounds see U.S. Pat. No. 5,262,295 at column 4, lines 17–47, incorporated herein by reference.

Non-limiting representative bis(hydroxynaphthyl-)methanes include 2,2'-methylene-bis(2-methyl-1-naphthol-)methane. For additional compounds see U.S. Pat. No. 5,262,295 at column 6, lines 14–16, incorporated herein by reference.

Non-limiting representative bis(hydroxyphenyl)methanes include bis(2-hydroxy-3-t-butyl-5-methylphenyl)methane (CAO-5); 1,1-bis(2-hydroxy- 3,5-dimethylphenyl)-3,5,5-trimethylhexane (Permanax™ or Nonox™); 1,1'-bis(3,5-tetra-t-butyl-4-hydroxy)methane; 2,2-bis(4-hydroxy-3-methylphenyl)propane; 4,4-ethylidene-bis(2-t-butyl-6-methylphenol); and 2,2-bis(3,5-dimethyl-4-hydroxyphenyl)propane. For additional compounds see U.S. Pat. No. 5,262,295 at column 5 line 63 to column 6, line 8 incorporated herein by reference.

Non-limiting representative hindered phenols include 2,6-di-t-butylphenol; 2,6-di-t-butyl-4-methylphenol; 2,4-di-t-butylphenol; 2,6-dichlorophenol; 2,6-dimethylphenol; and 2-t-butyl-6-methylphenol.

Non-limiting representative hindered naphthols include 1-naphthol; 4-methyl-1-naphthol; 4-methoxy-1-naphthol; 4-chloro-1-naphthol; and 2-methyl- 1-naphthol. For additional compounds see U.S. Pat. No. 5,262,295 at column 6, lines 17–20, incorporated herein by reference.

The reducing agent should be present as 1 to 10% by weight of the imaging layer. In multilayer elements, if the reducing agent is added to a layer other than an emulsion layer, slightly higher proportions, of from about 2 to 15%, tend to be more desirable.

The Optional Dye-Forming or Dye-Releasing Compound

As noted above, the reducing agent for the reducible source of silver may be a compound that can be oxidized directly or indirectly to form or release a dye.

Leuco dyes are one class of dye-forming compound that form a dye upon oxidation. Any leuco dye capable of being oxidized by silver ion to form a visible image can be used in the present invention. Leuco dyes that are both pH sensitive and oxidizable can also be used, but are not preferred. Leuco dyes that are sensitive only to changes in pH are not included within scope of dyes useful in this invention because they are not oxidizable to a colored form.

As used herein, a "leuco dye" or "blocked leuco dye" is the reduced form of a dye that is generally colorless or very lightly colored and is capable of forming a colored image upon oxidation of the leuco or blocked leuco dye to the dye form. Thus, the blocked leuco dyes (i.e., blocked dye-releasing compounds), absorb less strongly in the visible region of the electromagnetic spectrum than do the dyes. The resultant dye produces an image either directly on the sheet on which the dye is formed or, when used with a dye- or image-receiving layer, on the image-receiving layer upon diffusion through emulsion layers and interlayers.

Representative classes of leuco dyes that can used in the photothermographic elements of the present invention include, but are not limited to: chromogenie leuco dyes, such as indoaniline, indophenol, or azomethine leuco dyes; imidazole leuco dyes, such as 2-(3,5-di-t-butyl- 4-hydroxyphenyl)-4,5-diphenylimidazole, as described in U.S. Pat. No. 3,985,565; dyes having an azine, diazine, oxazine, or thiazine nucleus such as those described in U.S. Pat. Nos. 4,563,415; 4,622,395; 4,710,570; and 4,782,010; and benzylidene leuco compounds as described in U.S. Pat. No. 4,923,792.

Another preferred class of leuco dyes useful in this invention are those derived from azomethine leuco dyes or indoaniline leuco dyes. These are often referred to herein as "chromogenic leuco dyes" because many of these dyes are useful in conventional, wet-processed photography. Chromogenic dyes are prepared by oxidative coupling of a p-phenylenediamine compound or a p-aminophenol compound with a photographic-type coupler. Reduction of the corresponding dye as described, for example, in U.S. Pat. No. 4,374,921 forms the chromogenic leuco dye. Leuco chromogenic dyes are also described in U.S. Pat. No. 4,594,307. Cyan leuco chromogenic dyes having short chain carbamoyl protecting groups are described in European Laid Open Patent Application No. 533,008. For a review of chromogenic leuco dyes, see K. Venkataraman, *The Chemistry of Synthetic Dyes,* Academic Press: New York, 1952; Vol. 4, Chapter VI.

Another class of leuco dyes useful in this invention are "aldazine" and "ketazine" leuco dyes. Dyes of this type are described in U.S. Pat. Nos. 4,587,211 and 4,795,697. Benzylidene leuco dyes are also useful in this invention. Dyes of this type are described in U.S. Pat. No. 4,923,792.

Yet another class of dye-releasing compounds that form a diffusible dye upon oxidation are known as pre-formed-dye-release (PDR) or redox-dye-release (RDR) compounds. In these compounds, the reducing agent for the non-photosensitive, reducible source of silver releases a mobile pre-formed dye upon oxidation. Examples of these compouds are disclosed in Swain, U.S. Pat. No. 4,981,775.

Further, other image-forming compounds where the mobility of the compound having a dye part changes as a result of an oxidation-reduction reaction with silver halide, or an organic silver salt at high temperature can be used, as described in Japanese Patent Application No. 165,054/84.

Still further the reducing agent may be a compound that releases a conventional photographic dye coupler or developer on oxidation as is known in the art.

The dyes formed or released in the various color-forming layers should, of course, be different. A difference of at least 60 nm in reflective maximum absorbance is preferred. More preferably, the absorbance maximum of dyes formed or released will differ by at least 80–100 nm. When three dyes are to be formed, two should preferably differ by at least these minimums, and the third should preferably differ from at least one of the other dyes by at least 150 nm, and more preferably, by at least 200 nm. Any reducing agent capable of being oxidized by silver ion to form or release a visible dye is useful in the present invention as previously noted.

The total amount of optional leuco dye used as a reducing agent used in the present invention should preferably be in the range of 0.5–25 wt %, and more preferably, in the range of 1–10 wt %, based upon the total weight of each individual layer in which the reducing agent is employed.

The Binder

The photosensitive silver halide, the non-photosensitive reducible source of silver, the reducing agent system, and any other addenda used in the present invention are generally added to at least one binder. The binder(s) that can be used in the present invention can be employed individually or in combination with one another. It is preferred that the binder be selected from polymeric materials, such as, for example, natural and synthetic resins that are sufficiently polar to hold the other ingredients in solution or suspension.

A typical hydrophilic binder is a transparent or translucent hydrophilic colloid. Examples of hydrophilic binders include: a natural substance, for example, a protein such as gelatin, a gelatin derivative, a cellulose derivative, etc.; a polysaccharide such as starch, gum arabic, pullulan, dextrin, etc.; and a synthetic polymer, for example, a water-soluble polyvinyl compound such as polyvinyl alcohol, polyvinyl pyrrolidone, acrylamide polymer, etc. Another example of a hydrophilic binder is a dispersed vinyl compound in latex form which is used for the purpose of increasing dimensional stability of a photographic element.

Examples of typical hydrophobic binders are polyvinyl acetals, polyvinyl chloride, polyvinyl acetate, cellulose acetate, polyolefins, polyesters, polystyrene, polyacrylonitrile, polycarbonates, methacrylate copolymers, maleic anhydride ester copolymers, butadiene-styrene copolymers, and the like. Copolymers, e.g., terpolymers, are also included in the definition of polymers. The polyvinyl acetals, such as polyvinyl butyral and polyvinyl formal, and vinyl copolymers such as polyvinyl acetate and polyvinyl chloride are particularly preferred.

Although the binder can be hydrophilic or hydrophobic, preferably it is hydrophobic in the silver containing layer(s). Optionally, these polymers may be used in combination of two or more thereof.

The binders are preferably used at a level of about 30–90% by weight of the emulsion layer, and more preferably at a level of about 45–85% by weight. Where the proportions and activities of the reducing agent system for the non-photosensitive reducible source of silver require a particular developing time and temperature, the binder should be able to withstand those conditions. Generally, it is preferred that the binder not decompose or lose its structural integrity at 250° F. (121° C.) for 60 seconds, and more preferred that it not decompose or lose its structural integrity at 350° F. (177° C.) for 60 seconds.

The polymer binder is used in an amount sufficient to carry the components dispersed therein, that is, within the effective range of the action as the binder. The effective range can be appropriately determined by one skilled in the art.

Photothermographic Formulations

The formulation for the photothermographic emulsion layer can be prepared by dissolving and dispersing the binder, the photosensitive silver halide, the non-photosensitive reducible source of silver, the reducing agent system for the non-photosensitive reducible silver source, and optional additives, in an inert organic solvent, such as, for example, toluene, 2-butanone, or tetrahydrofuran.

The use of "toners" or derivatives thereof which improve the image, is highly desirable, but is not essential to the element. Toners can be present in an amount of about 0.01–10% by weight of the emulsion layer, preferably about 0.1–10% by weight. Toners are well known materials in the photothermographic art, as shown in U.S. Pat. Nos. 3,080,254; 3,847,612; and 4,123,282.

Examples of toners include: phthalimide and N-hydroxyphthalimide; cyclic imides, such as succinimide, pyrazoline-5-ones, quinazolinone, 1-phenylurazole, 3-phenyl-2-pyrazoline-5-one, and 2,4-thiazolidinedione; naphthalimides, such as N-hydroxy-1,8-naphthalimide; cobalt complexes, such as cobaltic hexamine trifluoroacetate; mercaptans such as 3-mercapto- 1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboximides, such as (N,N-dimethylaminomethyl)phthalimide, and N-(dimethylaminomethyl)naphthalene-2,3-dicarboximide; a combination of blocked pyrazoles, isothiuronium derivatives, and certain photo-bleach agents, such as a combination of N,N'-hexamethylene-bis( 1-carbamoyl- 3,5-dimethylpyrazole), 1,8-( 3,6-diazaoctane)bis(isothiuronium)trifluoroacetate, and 2-(tribromomethylsulfonyl benzothiazole); merocyanine dyes such as 3-ethyl-5-[(3-ethyl- 2-benzothiazolinylidene)-1-methyl-ethylidene]- 2-thio- 2,4-o-azolidinedione; phthalazinone, phthalazinone derivatives, or metal salts or these derivatives, such as 4-(1-naphthyl)phthalazinone, 6-chlorophthalazinone, 5,7-dimethoxyphthalazinone, and 2,3-dihydro- 1,4-phthalazinedione; a combination of phthalazine plus one or more phthalic acid derivatives, such as phthalic acid, 4-methylphthalic acid, 4-nitrophthalic acid, and tetrachlorophthalic anhydride, quinazolinediones, benzoxazine or naphthoxazine derivatives; rhodium complexes functioning not only as tone modifiers but also as sources of halide ion for silver halide formation in situ, such as ammonium hexachlororhodate (III), rhodium bromide, rhodium nitrate, and potassium hexachlororhodate (III), inorganic peroxides and persulfates, such as ammonium peroxydisulfate and hydrogen peroxide; benzoxazine-2,4-diones, such as 1,3-benzoxazine-2,4-dione, 8-methyl- 1,3-benzoxazine-2,4-dione, and 6-nitro- 1,3-benzoxazine-2,4-dione; pyrimidines and asym-triazines, such as 2,4-dihydroxypyrimidine, 2-hydroxy-4-aminopyrimidine, and azauracil; and tetraazapentalene derivatives, such as 3,6-dimercapto-1,4-dipheny-1H, 4H-2,3a,5,6a-tetraazapentalene and 1,4-di-(o-chlorophenyl)-3,6-dimercapto-1H, 4H-2,3a,5,6a-tetraazapentalene.

The photothermographic elements used in this invention can be further protected against the additional production of fog and can be stabilized against loss of sensitivity during storage. While not necessary for the practice of the invention, it may be advantageous to add mercury (II) salts to the emulsion layer(s) as an antifoggant. Preferred mercury (II) salts for this purpose are mercuric acetate and mercuric bromide.

Other suitable antifoggants and stabilizers, which can be used alone or in combination, with the RNA stabilizers of this invention include the thiazolium salts described in U.S. Pat. Nos. 2,131,038 and U.S. Pat. No. 2,694,716; the azaindenes described in U.S. Pat. No. 2,886,437; the triazaindolizines described in U.S. Pat. No. 2,444,605; the mercury salts described in U.S. Pat. No. 2,728,663; the urazoles described in U.S. Pat. No. 3,287,135; the sulfocatechols described in U.S. Pat. No. 3,235,652; the oximes described in British Patent No. 623,448; the polyvalent metal salts described in U.S. Pat. No. 2,839,405; the thiuronium salts described in U.S. Pat. No. 3,220,839; and palladium, platinum and gold salts described in U.S. Pat. Nos. 2,566,263 and 2,597,915. Stabilizer precursor compounds capable of releasing stabilizers upon application of heat during development can also be use in combination with the stabilizers of this invention. Such precursor compounds are described in, for example, U.S. Pat. Nos. 5,158,866, 5,175,081, 5,298,390, and 5,300,420.

Photothermographic elements of the invention can contain plasticizers and lubricants such as polyalcohols and diols of the type described in U.S. Pat. No. 2,960,404; fatty acids or esters, such as those described in U.S. Pat. Nos. 2,588,765 and 3,121,060; and silicone resins, such as those described in British Patent No. 955,061.

Photothermographic elements containing emulsion layers described herein may contain matting agents such as starch, titanium dioxide, zinc oxide, silica, and polymeric beads including beads of the type described in U.S. Pat. Nos. 2,992,101 and 2,701,245.

Emulsions in accordance with this invention may be used in photothermographic elements which contain antistatic or conducting layers, such as layers that comprise soluble salts, e.g., chlorides, nitrates, etc., evaporated metal layers, ionic polymers such as those described in U.S. Pat. Nos. 2,861,056, and 3,206,312 or insoluble inorganic salts such as those described in U.S. Pat. No. 3,428,451.

The photothermographic elements of this invention may also contain electroconductive under-layers to reduce static electricity effects and improve transport throuch processing equipment. Such layers are described in U.S. Pat. No. 5,310,640.

Photothermographic Constructions

The photothermographic elements of this invention may be constructed of one or more layers on a support. Single layer elements should contain the silver halide, the non-photosensitive, reducible silver source, the reducing agent system for the non-photosensitive reducible silver source, the binder as well as optional materials such as toners, acutance dyes, coating aids, and other adjuvants.

Two-layer constructions should contain silver halide and non-photosensitive, reducible silver source in one emulsion layer (usually the layer adjacent to the support) and some of the other ingredients in the second layer or both layers. Two layer constructions comprising a single emulsion layer coating containing all the ingredients and a protective topcoat are also envisioned.

Multicolor photothermographic dry silver elements can contain sets of these bilayers for each color or they can contain all ingredients within a single layer, as described in U.S. Pat. No. 4,708,928.

Barrier layers, preferably comprising a polymeric material, can also be present in the photothermographic element of the present invention. Polymers for the material of the barrier layer can be selected from natural and synthetic polymers such as gelatin, polyvinyl alcohols, polyacrylic acids, sulfonated polystyrene, and the like. The polymers can optionally be blended with barrier aids such as silica.

Photothermographic emulsions used in this invention can be coated by various coating procedures including wire wound rod coating, dip coating, air knife coating, curtain coating, or extrusion coating using hoppers of the type described in U.S. Pat. No. 2,681,294. If desired, two or more layers can be coated simultaneously by the procedures described in U.S. Pat. Nos. 2,761,791; 5,340,613; and British Patent No. 837,095. Typical wet thickness of the emulsion layer can be about 10–150 micrometers (μm), and the layer can be dried in forced air at a temperature of about 20°–100° C. It is preferred that the thickness of the layer be selected to provide maximum image densities greater than 0.2, and, more preferably, in the range 0.5 to 4.5, as measured by a MacBeth Color Densitometer Model TD 504 using the color filter complementary to the dye color.

Photothermographic elements according to the present invention can contain acutance dyes and antihalation dyes. The dyes may be incorporated into the photothermographic emulsion layer as acutance dyes according to known techniques. The dyes may also be incorporated into antihalation layers according to known techniques as an antihalation backing layer, an antihalation underlayer or as an overcoat. It is preferred that the photothermographic elements of this invention contain an antihalation coating on the support opposite to the side on which the emulsion and topcoat layers are coated. Antihalation and acutance dyes useful in the present invention are described in U.S. Pat. Nos. 5,135,842; 5,226,452; 5,314,795.

Development conditions will vary, depending on the construction used, but will typically involve heating the photothermographic element in a substantially water-free condition after, or simultaneously with, imagewise exposure at a suitably elevated temperature. Thus, the latent image obtained after exposure can be developed by heating the element at a moderately elevated temperature of, from about 80° C. to about 250° C. (176° F. to 482° F.), preferably from about 100° C. to about 200° C., (212° F. to 392° F.), for a sufficient period of time, generally about 1 second to about 2 minutes. When used in a black-and-white element, a black-and-white silver image. When used in a monochrome or full-color element, a dye image is obtained simultaneously with the formation of a black-and-white silver image is obtained. Heating may be carried out by the typical heating means such as an oven, a hot plate, an iron, a hot roller, a heat generator using carbon or titanium white, or the like.

If desired, the imaged element may be subjected to a first heating step at a temperature and for a time sufficient to intensify and improve the stability of the latent image but insufficient to produce a visible image and later subjected to a second heating step at a temperature and for a time sufficient to produce the visible image. Such a method and its advantages are described in U.S. Pat. No. 5,279,928.

The Support

Photothermographic emulsions used in the invention can be coated on a wide variety of supports. The support, or substrate, can be selected from a wide range of materials depending on the imaging requirement. Supports may be transparent or at least translucent. Typical supports include polyester film, subbed polyester film (e.g.,polyethylene terephthalate or polyethylene naphthalate), cellulose acetate film, cellulose ester film, polyvinyl acetal film, polyolefinic film (e.g., polethylene or polypropylene or blends thereof), polycarbonate film and related or resinous materials, as well as glass, paper, and the like. Typically, a flexible support is employed, especially a polymeric film support, which can be partially acetylated or coated, particularly with a polymeric subbing or priming agent. Preferred polymeric materials for the support include polymers having good heat stability, such as polyesters. Particularly preferred polyesters are polyethylene terephthalate and polyethylene naphthalate.

A support with a backside resistive heating layer can also be used photothermographic imaging systems such as shown in U.S. Pat. No. 4,374,921.

The Image-Receiving Layer

When the reactants and reaction products of photothermographic systems that contain compounds capable of being oxidized to form or release a dye remain in contact after imaging, several problems can result. For example, thermal development often forms turbid and hazy color images because of dye contamination by the reduced metallic silver image on the exposed area of the emulsion. In addition, the resulting prints tend to develop color in unimaged background areas. This is often referred to as "leuco dye backgrounding." This "background stain" is caused by slow post-processing reaction between the dye-forming or dye-releasing compound and reducing agent. It is therefore desirable to transfer the dye formed upon imaging to a receptor, or image-receiving layer.

Thus, the photothermographic element may further comprise an image-receiving layer. Images derived from the photothermographic elements employing compounds capable of being oxidized to form or release a dye, such as, as for example, leuco dyes, are typically transferred to an image-receiving layer.

If used, dyes generated during thermal development of light-exposed regions of the emulsion layers migrate under development conditions into the an image-receiving or dye-receiving layer wherein they are retained. The dye-receiving layer may be composed of a polymeric material having affinity for the dyes employed. Necessarily, it will vary depending on the ionic or neutral characteristics of the dyes.

The image-receiving layer can be any flexible or rigid, transparent layer made of thermoplastic polymer. The image-receiving layer preferably has a thickness of at least 0.1 μm, more preferably from about 1–10 μm, and a glass transition temperature ($T_g$) of from about 20° C. to about 200° C. In the present invention, any thermoplastic polymer or combination of polymers can be used, provided the polymer is capable of absorbing and fixing the dye. Because the polymer acts as a dye mordant, no additional fixing agents are required. Thermoplastic polymers that can be used to prepare the image-receiving layer include polyesters, such as polyethylene terephthalates; polyolefins, such as polyethylene; cellulosics, such as cellulose acetate, cellulose butyrate, cellulose propionate; polystyrene; polyvinyl chloride; polyvinylidine chloride; polyvinyl acetate; copolymer of vinyl chloride-vinyl acetate; copolymer of vinylidene chlorideacrylonitrile; copolymer of styrene-acrylonitrile; and the like.

The optical density of the dye image and even the actual color of the dye image in the image-receiving layer is very much dependent on the characteristics of the polymer of the image-receiving layer, which acts as a dye mordant, and, as such, is capable of absorbing and fixing the dyes. A dye image having a reflection optical density in the range of from 0.3 to 3.5 (preferably, from 1.5 to 3.5) or a transmission optical density in the range of from 0.2 to 2.5 (preferably, from 1.0 to 2.5) is desirable.

The image-receiving layer can be formed by dissolving at least one thermoplastic polymer in an organic solvent (e.g., 2-butanone, acetone, tetrahydrofuran) and applying the resulting solution to a support base or substrate by various coating methods known in the art, such as curtain coating, extrusion coating, dip coating, air-knife coating, hopper coating, and any other coating method used for coating solutions. After the solution is coated, the image-receiving layer is dried (e.g., in an oven) to drive off the solvent. The image-receiving layer may be strippably adhered to the photothermographic element. Strippable image-receiving layers are described in U.S. Pat. No. 4,594,307.

Selection of the binder and solvent to be used in preparing the emulsion layer significantly affects the strippability of the image-receiving layer from the photosensitive element. Preferably, the binder for the image-receiving layer is impermeable to the solvent used for coating the emulsion layer and is incompatible with the binder used for the emulsion layer. The selection of the preferred binders and solvents results in weak adhesion between the emulsion layer and the image-receiving layer and promotes good strippability of the emulsion layer.

The photothermographic element can also include coating additives to improve the strippability of the emulsion layer. For example, fluoroaliphatic polyesters dissolved in ethyl acetate can be added in an amount of from about 0.02–0.5 wt % of the emulsion layer, preferably from about 0.1–0.3 wt %. A representative example of such a fluoroaliphatic polyester is "Fluorad FC 431", (a fluorinated surfactant available from 3M Company, St. Paul, Minn.). Alternatively, a coating additive can be added to the image-receiving layer in the same weight range to enhance strippability. No solvents need to be used in the stripping process. The strippable layer preferably has a delaminating resistance of 1 to 50 g/cm and a tensile strength at break greater than, preferably at least two times greater than, its delaminating resistance.

Preferably, the image-receiving layer is adjacent to the emulsion layer in order to facilitate transfer of the dye that forms after the imagewise exposed emulsion layer is subjected to thermal development, for example, in a heated shoe-and-roller-type heat processor.

Photothermographic multi-layer constructions containing blue-sensitive emulsions containing a yellow dye-forming or dye-releasing compound can be overcoated with green-sensitive emulsions containing a magenta dye-forming or dye-releasing compound. These layers can in turn be overcoated with a redsensitive emulsion layer containing a cyan dye-forming or dye-releasing compound. Imaging and heating to form or release the yellow, magenta, and cyan dyes in an imagewise fashion. The dyes so formed or released may migrate to an image-receiving layer. The image-receiving layer can be a permanent part of the construction or it can be removable, "i.e., strippably adhered," and subsequently peeled from the construction. Color-forming layers can be maintained distinct from each other by the use of functional or non-functional barrier layers between the various photosensitive layers as described in U.S. Pat. No. 4,460,681. False color address, such as that shown in U.S. Pat. No. 4,619,892, can also be used rather than blue-yellow, green-magenta, or red-cyan relationships between sensitivity and dye formation or release. False color address is particularly useful when imaging is performed using longer wavelength light sources, especially red or near infrared light sources, to enable digital address by lasers and laser diodes.

If desired, the dyes formed or released in the emulsion layer can be transferred onto a separately coated image-receiving sheet by placing the exposed emulsion layer in intimate face-to-face contact with the image-receiving sheet and heating the resulting composite construction. Good results can be achieved in this second embodiment when the layers are in uniform contact for a period of time of about 0.5–300 seconds at a temperature of about 80°–220° C.

In another embodiment, a multi-colored image can be prepared by superimposing in register a single image-receiving sheet successively with two or more imagewise exposed photothermographic elements, each of which forms or releases a dye of a different color, and heating to transfer the thus formed or released dyes as described above. This method is particularly suitable for the production of color proofs especially when the dyes formed or released have hues that match the internationally agreed standards for color reproduction (Standard Web Offset Printing colors or SWOP colors). Dyes with this property are disclosed in U.S. Pat. No. 5,023,229. In this embodiment, the photothermographic elements are preferably all sensitized to the same wavelength range regardless of the color of the dye formed or released. For example, the elements can be sensitized to ultraviolet radiation with a view toward contact exposure on conventional printing frames, or they can be sensitized to longer wavelengths, especially red or near infra-red, to enable digital address by lasers and laser diodes. As noted above, false color address is again particularly useful when imaging is performed using longer wavelength light sources, especially red or near infrared light sources, to enable digital address by lasers and laser diodes.

Use as a Photomask

As noted above, the possibility of low absorbance of the photothermographic element in the range of 350–450 nm in non-imaged areas facilitates the use of the photothermographic elements of the present invention in a process where there is a subsequent exposure of an ultraviolet or short wavelength visible radiation sensitive imageable medium. For example, imaging the photothermographic element with coherent radiation and subsequent development affords a visible image. The developed photothermographic element absorbs ultraviolet or short wavelength visible radiation in the areas where there is a visible image and transmits ultraviolet or short wavelength visible radiation where there is no visible image. The developed element may then be used as a mask and placed between an ultraviolet or short wavelength visible radiation energy source and an ultraviolet or short wavelength visible radiation photosensitive imageable medium such as, for example, a photopolymer, diazo compound, or photoresist. This process is particularly useful where the imageable medium comprises a printing plate and the photothermographic element serves as an imagesetting film.

Objects and advantages of this invention will now be illustrated by the following examples, but the particular materials and amounts thereof recited in these examples, as well as other conditions and details, should not be construed to unduly limit this invention.

EXAMPLES

All materials used in the following examples were readily available from standard commercial sources, such as Aldrich Chemical Co. (Milwaukee, Wis.). All percentages are by weight unless otherwise indicated. The following additional terms and materials were used.

Acryloid™ A-21 is a polymethyl methacrylate polymer available from Rohm and Haas, Philadelphia, Pa.

Butvar™ B-76 is a polyvinyl butyral resin available from Monsanto Company, St. Louis, Mo.

CA 398-6 is a cellulose acetate polymer available from Eastman Chemical Co., Kingsport, Tenn.

CAB 171-15S cellulose acetate butyrate polymer available from Eastman Chemical Co., Kingsport, Tenn.

CAOô 5 is bis(2-hydroxy-3-t-butyl- 5-methylphenyl-)methane, an antioxidant available from Rohm and Haas, Philadelphia, Pa. It is a reducing agent (i.e., a developer) for the non-photosensitive reducible source of silver.

CBBA is 2-(4-chlorobenzoyl)benzoic acid.

MEK is methyl ethyl ketone (2-butanone).

MMBI is 5-methyl-2-mercaptobenzimidazole.

4-MPA is 4-methylphthalic acid.

Nonox™ is 1,1-bis (2-hydroxy- 3,5-dimethylphenyl)-3,5, 5-trimethylhexane [CAS RN=7292-14-0] and is available from St. Jean PhotoChemicals, Inc., Quebec. It is a reducing agent (i.e., a developer) for the non-photosensitive reducible source of silver. It is also known as Permanax™ WSO.

PHZ is phthalazine.

PHP is pyridinium hydrobromide perbromide.

TCPAN is tetrachlorophthalic anhydride.

THDI is Desmodur™ N-100, a biuretized hexamethylenediisocyanate available from Miles Chemical Corporation.

Sensitizing Dye-1 is described in U.S. Pat. No. 3,719,495 and has the structure shown below.

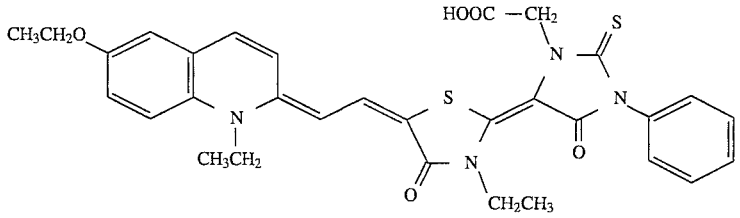

Sensitizing Dye-2 is described in U.S. Pat. No. 5,393,654 and has the structure shown below.

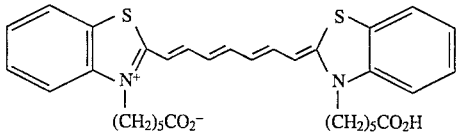

Type IV RNA: from Calf Liver, (prepared by the procedure of K. S. Kirby *Biochem. J.* 1956, 64, 405) is a white crystal and was obtained from Sigma Chemical Company (St. Louis, Mo.). The sample was kept refrigerated until used.

Example 1

A 13.6 wt % emulsion of silver behenate/behenic acid half soap was made in acetone by homogenization. To 201.5 g of this emulsion was added 1.12 g of Butvar™ B-76 polyvinyl butyral and the mixture was stirred 30 minutes. Three 1.00 mL aliquots of a solution of 10.0 g zinc bromide in 100.0 mL methanol were added sequentially with stirring for 10 minutes after each addition. Toluene (66.66 g) was added and the mixture was stirred for an additional 15 minutes. A solution (2.40 mL) containing 4.00 g of pyridine in 100 mL of 2-butanone was added with continued stirring for 15 minutes. The mixture was allowed to stand for 4 hours at room temperature.

To this emulsion was added 31.75 g of Butvar™ B-76 and the emulsion stirred for 30 minutes. This was followed by the addition of 2.73 mL of a solution of 1.33 g N-bromosuccinimide in 100 mL methanol. CAO™ 5 (4.20 g) was added with stirring for 5 minutes. Acryloid™ A-21 (27.22 g) was added with stirring for 5 minutes.

The following steps were then carried out under green safelights. A 6.00 mL aliquot of a solution of 0.03 g of Sensitizing Dye-1 in 25.00 mL of methanol and 75 mL of toluene was added to the above emulsion and the mixture was stirred for 5 minutes. At this stage, the viscosity of the resultant photothermographic formulation should be between 180 and 220 centipoise. If the viscosity is greater than 220 centipoise, acetone should be added to bring the viscosity into the desired range. The photothermographic emulsion was coated at 4.4 mil (112 μm) wet thickness onto paper and dried at 180° F. (82.2° C.) for one minute to give a dry coating weight of 1.25 gm/ft$^2$.

A master batch of topcoat solution was prepared by mixing: 164.728 g of acetone, 82.350 g of 2-butanone, 33.300 g of methanol, 13.500 g of CA 398-6 cellulose acetate, 1.542 g of phthalazine, 1.068 g of 4-methylphthalic acid, 0.636 g of tetrachlorophthalic acid, and 0.800 g of tetrachlorophthalic anhydride.

Three levels of each RNA compound was evaluated by addition to a 7.00 g aliquot of the master batch of topcoat solution before coating. The samples were then placed in an ultrasonic bath for various times. All solutions were decanted to remove any materials that were not soluble.

The topcoat formulation was coated at 2.8 mil (71 μm), wet thickness, on top of the photothermographic emulsion layer and dried for 3 minutes at 70° C. to provide a dry coating weight of 0.24 gm/ft$^2$.

The photothermographic elements were stored in the dark at room temperature for 1 day and for 7 days before imaging. These samples are referred to herein as 1 day and 7 day naturally aged samples.

The coated paper was imaged by exposing a sample with a photometric sensitometer equipped with an Eastman Kodak #101 tungsten light source. After exposure, the strips (1 inch×7 inches; 2.5 cm×17.8 cm) were processed at 250° F. (121° C.) by heating for 6 seconds in a hot roll processor.

Sensitometry measurements were made on a custom-built computer-scanned densitometer and are believed to be comparable to measurements obtainable from commercially available densitometers.

Sensitometric results for the 1 day naturally aged samples, shown below, demonstrate that addition of RNA provides improved stabilization against shelf-aging fog.

1 Day Shelf-Aging Stability Results

| Compound/Amount | Time (min) | Dmin | Dmax | Speed* |
|---|---|---|---|---|
| Calf RNA | | | | |
| 0.0000 g | 0 minutes | 0.39 | 1.73 | 0.81 |
| 0.0042 g | | 0.22 | 1.76 | 0.90 |
| 0.0168 g | | 0.24 | 1.73 | 0.88 |
| 0.0840 g | | 0.28 | 1.71 | 0.87 |
| 0.0000 g | 5 minutes | 0.39 | 1.73 | 0.81 |
| 0.0042 g | | 0.20 | 1.73 | 0.87 |
| 0.0168 g | | 0.25 | 1.74 | 0.85 |
| 0.0840 g | | 0.28 | 1.70 | 0.89 |
| 0.0000 g | 15 minutes | 0.39 | 1.73 | 0.81 |
| 0.0042 g | | 0.26 | 1.70 | 0.90 |
| 0.0168 g | | 0.20 | 1.70 | 0.87 |
| 0.0840 g | | 0.20 | 1.72 | 0.90 |
| 0.0000 g | 60 minutes | 0.39 | 1.73 | 0.81 |
| 0.0042 g | | 0.28 | 1.76 | 0.90 |
| 0.0168 g | | 0.26 | 1.73 | 0.88 |
| 0.0840 g | | 0.24 | 1.71 | 0.87 |

*Speed is log E (E in ergs/cm$^2$) corresponding to a density of 0.6 above Dmin. In these samples, the lower the speed number, the "faster" the photospeed of the paper.

Samples were allowed to naturally age for 7 days in the dark at room temperature before imaging. They were then exposed and processed. Sensitometric results, shown below, demonstrate that addition of RNA provides improved stabilization against shelf-aging fog.

7 Day Shelf-Aging Stability Results

| Compound/Amount | Time (min) | Dmin | Dmax | Speed* |
|---|---|---|---|---|
| Calf RNA | | | | |
| 0.0000 g | 0 minutes | 0.42 | 1.73 | 0.87 |
| 0.0042 g | | 0.22 | 1.74 | 0.89 |
| 0.0168 g | | 0.25 | 1.74 | 0.86 |
| 0.0840 g | | 0.27 | 1.74 | 0.84 |
| 0.0000 g | 5 minutes | 0.42 | 1.73 | 0.87 |
| 0.0042 g | | 0.25 | 1.72 | 0.86 |
| 0.0168 g | | 0.27 | 1.74 | 0.84 |
| 0.0840 g | | 0.27 | 1.65 | 0.83 |
| 0.0000 g | 15 minutes | 0.42 | 1.73 | 0.81 |
| 0.0042 g | | 0.28 | 1.70 | 0.87 |
| 0.0168 g | | 0.24 | 1.70 | 0.85 |
| 0.0840 g | | 0.21 | 1.68 | 0.84 |
| 0.0000 g | 60 minutes | 0.42 | 1.73 | 0.81 |
| 0.0042 g | | 0.29 | 1.74 | 0.79 |
| 0.0168 g | | 0.26 | 1.70 | 0.78 |
| 0.0840 g | | 0.25 | 1.65 | 0.76 |

*Speed is log E (E in ergs/cm$^2$) corresponding to a density of 0.6 above Dmin. In these samples, the lower the speed number, the "faster" the photospeed of the paper.

The samples that had not been sonicated and had been naturally aged for 1 day were used to test post-processing print stability. The optical density of the samples was measured on a Macbeth TR 924 Densitometer using the visible filter. The samples were then placed in a light chamber at room temperature for 72 hours at 100 foot-candles illumination After 72 hours the samples were removed and their optical density remeasured on the Macbeth TR 924 Densitometer.

The sensitometric results, shown below, demonstrate that the RNA compounds in this invention provide improved post-processing print stability. In all cases, the post-processing print stability improved as the amount of RNA compound was increased. For example, the addition of calf RNA resulted in print stability improvements of from 47% (upon addition of 0.0042 g) to 63% (upon addition of 0.0840 g). ΔDmin is Dmin (Final)—Dmin (Initial).

Post Processing Print Stability

| Compound/Amount | Initial Dmin | Final Dmin | Δ Dmin |
|---|---|---|---|
| Calf RNA | | | |
| 0.0000 g | 0.39 | 0.58 | 0.19 |
| 0.0042 g | 0.22 | 0.32 | 0.10 |
| 0.0168 g | 0.24 | 0.32 | 0.09 |
| 0.0840 g | 0.28 | 0.35 | 0.07 |

Example 2

A silver halide-silver behenate dry soap was prepared by the procedures described in U.S. Pat. No. 3,839,049. The silver halide totaled 9% of the total silver while silver behenate comprised 91% of the total silver. The silver halide was a 0.055 μm silver bromoiodide emulsion with 2% iodide.

The following steps were carried under green safe lights: A photothermographic emulsion was prepared by homogenizing 300 g of the silver halide-silver behenate dry soap described above with 525 g of toluene, 1675 g of 2-butanone, and 50 g of Butvar™ B-76. The homogenized photothermographic emulsion (514 g) was cooled to 55° F. (12.8° C.) with stirring. A solution of 0.63 g of pyridinium hydrobromide perbromide (PHP) in 2.61 g of methanol was added and stirring continued for 2 hours. The addition of a calcium bromide solution (prepared by dissolving 0.48 g of $CaBr_2$ in 2.61 g of methanol) was followed by 30 minutes of stirring. Butvar™ B-79 (116.92 g) was added and stirring continued for 20 minutes. The mixture was allowed to stand for 16 hours at 55° F. (12.8° C.).

The following steps were carried under infrared safe lights: To the stirred emulsion was added 19.44 g of Nonox™ followed by a solution of 1.035 g of THDI in 40 g of 2-butanone. Stiring was maintined and after 15 minutes 0.3767 g of 5-methyl-2-mercaptobenzimidazole (MMBI), 4.229 g of 2-(4-chlorobenzoyl)benzoic acid (CBBA), and a solution of 0.072 g of Sensitizing Dye 2 in 25.33 g of methanol were added. After 15 minutes a mixture of 0.7414 g tetrachlorophthalic acid and 2.208 g phthalazine were added and the emulsion allowed to stir for 15 minutes.

A master batch of topcoat solution was prepared by mixing 703 mL of 2-butanone, 66.18 g of methanol, 51.06 g of of CAB 171-15S cellulose acetate butyrate), 1.723 g of 4-methylphthalic acid, and 2.12 g Acryloid™-21. Three levels of each RNA compound was evaluated by addition to a 14.00 g aliquot of the master batch of topcoat solution before coating. The samples were then placed in an ultrasonic bath for various times. All solutions were decanted to remove any materials that were not soluble.

The photothermographic emulsion and and topcoat formulations were coated onto a 7 mil (178 μm) polyethylene terephthalate support using a dual-knife coater. This apparatus consists of two knife coating blades in series. The support was cut to a length suitable to the volume of solution used, and after raising the hinged knives, placed in position on the coater bed. The knives were then lowered and locked into place. The height of the knives was adjusted with wedges controlled by screw knobs and measured with electronic gauges. Knife #1 was raised to a clearance corresponding to the thickness of the support plus the desired wet thickness of the emulsion layer (layer #1). Knife #2 was raised to a height equal to the desired thickness of the support plus the desired wet thickness the emulsion layer (layer #1) plus the disired wet thickness of the topcoat layer (layer #2).

The photothermographic emulsion layer was coated at a wet thickness of 4.9 mil (125 μm) above the support to give a dry coating weight of 1.98 gm/ft$^2$. The topcoat was coated over the photothermographic emulsion layer at a wet thickness of 6.9 mil (175 μm) above the support to give a dry coating weight of 0.24 gm/ft$^2$. The photothermographic element was dried for four minutes at 175 ° F. (79.4° C.).

The photothermographic element was imaged by exposing with a laser sensitometer (813 nm) with a infrared light source. After exposure, the strips (1 inch×7 inches; 2.5 cm×17.8 cm) were processed at 250° F. (121° C.) by heating for 15 seconds on a hot roll processor.

Sensitometric measurements were made on a custom-built computer-scanned densitometer and are believed to be comparable to measurements obtainable from commercially available densitometers.

Sensitometric evaluation results for the 1 day naturally aged samples, shown below, demonstrate that incorporation of RNA compounds into photothermographic elements provides improved Dmin stability twoard shelf-aging fog. Some desensitization of the emulsion at various RNA concentrations was found.

1 Day Shelf-Aging Results

| Compound/Amount | Time (min) | Dmin | Dmax | Speed* |
|---|---|---|---|---|
| Calf RNA | | | | |
| 0.0000 g | 0 minutes | 0.55 | 4.30 | 1.36 |
| 0.0042 g | | 0.37 | 3.60 | 1.28 |
| 0.0168 g | | 0.36 | 3.30 | 1.26 |
| 0.0840 g | | 0.36 | 3.50 | 1.29 |
| 0.0000 g | 10 minutes | 0.55 | 4.30 | 1.36 |
| 0.0042 g | | 0.37 | 3.60 | 1.28 |
| 0.0168 g | | 0.36 | 3.30 | 1.26 |
| 0.0840 g | | 0.36 | 3.50 | 1.29 |
| 0.0000 g | 60 minutes | 0.55 | 4.30 | 1.36 |
| 0.0042 g | | 0.42 | 3.60 | 1.28 |
| 0.0168 g | | 0.41 | 3.30 | 1.26 |
| 0.0840 g | | 0.38 | 3.50 | 1.29 |

*Speed is log l/E (E in ergs/cm$^2$)+4 corresponding to a density of 1.00 above Dmin. In these samples, the higher the speed number, the "faster" the film.

Sensitometric results for the 7 day naturally aged samples, shown below, again demonstrate addition of RNA to the photothermographic element provides improved stabilization against shelf-aging fog. Samples without RNA compounds (0.0000 g) gave a high fog (Dmin>1.0). Samples containing various amounts of RNA compounds were found to retain low Dmin values.

7 Day Shelf-Aging Results

| Compound/Amount | Time (min) | Dmin | Dmax | Speed* |
|---|---|---|---|---|
| Calf RNA | | | | |
| 0.0000 g | 0 minutes | Highly Fogged | | — |
| 0.0042 g | | 0.36 | 3.40 | 1.30 |
| 0.0168 g | | 0.35 | 3.10 | 1.26 |
| 0.0840 g | | 0.34 | 3.40 | 1.30 |
| 0.0000 g | 10 mimutes | Highly Fogged | | — |
| 0.0042 g | | 0.40 | 4.00 | 1.40 |
| 0.0168 g | | 0.40 | 4.05 | 1.30 |
| 0.0840 g | | 0.37 | 3.72 | 1.26 |
| 0.0000 g | 60 minutes | Highly Fogged | | — |
| 0.0042 g | | 0.43 | 4.20 | 1.40 |
| 0.0168 g | | 0.40 | 4.00 | 1.35 |
| 0.0840 g | | 0.39 | 3.60 | 1.30 |

*Speed is log E (E in ergs/cm$^2$)+4 corresponding to a density of 1.00 above Dmin. In these samples, the higher the speed number, the "faster" the film.

The samples that had been naturally aged for 1 day were used to test post-processing print stability. The optical density of the samples were measured on a Macbeth TR 924 Densitometer using the additive blue filter. Samples were then placed in a heat and light chamber controlled to 45° C. and 20% RH for 10 hours at 1200 foot-candles illumination. After 72 hours the samples were removed and their optical density remeasured on the Macbeth TR 924 Densitometer.

Sensitometric results, shown below, demonstrate that the RNA compounds of this invention provide improved post-processing print stability. In all cases, the post-processing print stability improved as the amount of RNA compound was increased. The observed print stability improvements in testing of RNA were from 24% (0.0840 g) to 8% (0.0042 g) better than the control when measured with the additive blue filter.

| Change in Optical Density after 72 Hours - Calf RNA | | | |
|---|---|---|---|
| Amount | Initial Dmin | Final Dmin | Δ Dmin |
| 0.0000 g | 0.55 | 0.80 | 0.25 |
| 0.0042 g | 0.37 | 0.60 | 0.23 |
| 0.0168 g | 0.36 | 0.58 | 0.22 |
| 0.0840 g | 0.36 | 0.55 | 0.19 |

Reasonable modifications and variations are possible from the foregoing disclosure without departing from either the spirit or scope of the present invention as defined by the claims.

What we claim is:

1. A black-and-white photothermographic element comprising a support bearing at least one photosensitive image-forming photothermographic emulsion layer comprising:

(a) a photosensitive silver halide;

(b) a non-photosensitive, reducible source of silver;

(c) a reducing agent for the non-photosensitive, reducible source of silver;

(d) a binder; and (e) RNA.

2. The photothermographic element according to claim 1 wherein the silver halide is silver bromide, silver chloride, silver iodide, silver chlorobromide, silver bromoiodide, silver chlorobromoiodide, or mixtures thereof.

3. The photothermographic element according to claim 1 wherein said non-photosensitive, reducible source of silver is a silver salt of a $C_1$ to $C_{30}$ carboxylic acid.

4. The photothermographic element according to claim 3 wherein said non-photosensitive silver source is silver behenate.

5. The photothermographic element according to claim 1 wherein said binder is hydrophilic.

6. The photothermographic element according to claim 1 wherein said binder is hydrophobic.

7. The photothermographic element according to claim 1 wherein said reducing agent is a hindered phemol.

8. The photothermographic element of claim 7 wherein said hindered phenol is selected from the group consisting of binaphthols, biphenols, bis(hydroxynaphthyl)methanes, bis(hydroxyphenyl)methanes, hindered phenols, and naphthols.

9. The photothermographic element of claim 8 wherein said hindered phenol is a bis(hydroxyphenyl)methane.

10. The photothermographic element of claim 1 wherein said RNA is Calf Liver RNA.

11. A process for the formation of a visible image comprising exposing the black-and-white photothermographic element of claim 1 to light to form a latent image and subsequently heating said exposed element.

* * * * *